US006273849B1

(12) United States Patent
Scherer

(10) Patent No.: US 6,273,849 B1
(45) **Date of Patent: *Aug. 14, 2001**

(54) CENTRIFUGE AND LINE FOR SUPPLYING AND/OR REMOVING AT LEAST ONE FLUID FROM THE SEPARATION UNIT OF A CENTRIFUGE TO A STATIONARY CONNECTION

(75) Inventor: Thomas Scherer, Breitenbach (DE)

(73) Assignee: Fresenius AG, Bad Homburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,314

(22) Filed: Jan. 19, 1999

(51) Int. Cl.[7] ..... B04B 7/00
(52) U.S. Cl. ..... 494/37; 494/83
(58) Field of Search ..... 494/12, 18, 21, 494/45, 83, 84, 85, 37; 210/380.1, 781, 782; 422/101

(56) References Cited

U.S. PATENT DOCUMENTS 4,109,852 * 8/1978 Brown et al. .
4,114,802 9/1978 Brown .
4,120,448 * 10/1978 Cullis .
4,164,318 * 8/1979 Boggs .
4,221,322 * 9/1980 Drago et al. .
4,439,178 3/1984 Mulzet .
4,710,161 * 12/1987 Takabayashi et al. ..... 494/18
5,362,291 * 11/1994 Williamson, IV ..... 494/18
5,501,840 * 3/1996 Mantovani et al. ..... 422/101
5,514,069 * 5/1996 Brown et al. ..... 494/18
5,704,887 * 1/1998 Slowik et al. ..... 494/18
5,989,177 * 11/1999 West et al. ..... 494/83

FOREIGN PATENT DOCUMENTS

4220232 * 12/1993 (DE) ..... 494/45
112990 * 7/1984 (EP) ..... 494/45
2305238 * 10/1976 (FR) ..... 494/18
WO 93/12887 7/1993 (WO) .

* cited by examiner

*Primary Examiner*—Charles E. Cooley
(74) *Attorney, Agent, or Firm*—Kenyon & Kenyon

(57) ABSTRACT

With flow-through centrifuges free of rotating seals, the line leading from the stationary connection to the rotating separation unit for supplying and/or removing the fluid is subjected to relatively great mechanical stresses. The centrifuge according to the present invention has a bearing shell (13) into which is inserted a sliding bushing (9) that is provided on the line to support the line on the rotating frame (1) carrying the separation unit. Bearing shell (13) and sliding bushing (9) have widening sliding surfaces (11, 15) so that the contact surface can be minimized. The line (6) can be produced inexpensively as a disposable article, because it includes only the sliding bushing (9) of the bearing.

16 Claims, 2 Drawing Sheets

CENTRIFUGE AND LINE FOR SUPPLYING AND/OR REMOVING AT LEAST ONE FLUID FROM THE SEPARATION UNIT OF A CENTRIFUGE TO A STATIONARY CONNECTION

FIELD OF THE INVENTION

The present invention relates to a centrifuge, in particular a flow-through centrifuge free of rotating seals, for centrifuging biological fluids and a line for supplying and/or removing at least one fluid from the separation unit of such a centrifuge to a stationary connection.

RELATED TECHNOLOGY

There are known centrifuges where the biological fluid is centrifuged in a flow-through process. The fluid is supplied to the rotating centrifuge chamber and removed from it through a line. However, guidance of the line has proven to be problematical because of the relative movement of the centrifuge chamber and the stationary connection of the line. To prevent twisting of the line, rotating seals are used at the connections on conventional flow-through centrifuges. Although such centrifuges permit a high speed of rotation, they have the disadvantage that the rotating couplings can lead to abrasion, leakage and thus contamination and damage of the components present in the fluid.

A flow-through centrifuge free of rotating seals is disclosed in German Patent Application No. 32 42 541 A. With this centrifuge, which is free of rotating seals, the line is passed from a stationary connection in a loop around the centrifuge chamber. To that end, the line is connected to a rotating frame which rotates at half speed in comparison with the centrifuge chamber. Such a flow-through centrifuge is also disclosed, for example, in German Patent Application No. 42 20 232 A. With this flow-through centrifuge free of rotating seals, the line is subjected to relatively great mechanical stresses, which increase greatly with increased speed of rotation. Under the influence of centrifugal forces, the line develops a loop which protrudes outward, as a result of which high alternate bending stresses develop at the stationary connection and the connection to the separation unit. The steep incoming and outgoing angles at the connections lead to additional friction between the adapters and the line, which in turn results in increased abrasion. The alternate bending stresses and the abrasion are factors that limit the life of the line and the maximum rotational speed of the centrifuge.

There are known flow-through centrifuges free of rotating seals which use bearings to support the line. International Patent Application No. WO 95/17261 describes a flow-through centrifuge whose centrifuge hose is supported by a roller bearing. The roller bearing, which has an inside and an outside bearing shell with the rolling element, is part of the line. The roller bearing does offer the advantage of low bearing friction, but it has the disadvantage that manufacture is expensive and thus the price is relatively high. This is a particular disadvantage since the centrifuge line is a disposable article which is discarded after use.

European Patent Application No. 112 990 A describes a flow-through centrifuge whose centrifuge hose is supported between the stationary connection and the connection of the separation unit by two friction bearings. The friction bearings each have inside and outside bearing shells with a cylindrical running surface which are part of the centrifuge hose, which is why the hose is relatively expensive to manufacture. The sliding surface is large, thereby producing high abrasion and heat. In addition, this bearing arrangement does not have sufficient axial support to prevent the bushing from slipping out of the sleeve.

SUMMARY OF THE INVENTION

An object of the present invention is to create a centrifuge whose line for supplying and/or removing at least one fluid is exposed to relatively minor mechanical stresses, but can nevertheless be manufactured easily and inexpensively as a disposable article.

The present invention provides a centrifuge with a rotating frame (1) which is rotatably mounted on a base (2), a separation unit (4) which is rotatably mounted on the base (2) and can be driven in the same direction as the rotating frame but at twice the speed, a line (6) for supplying and/or removing at least one fluid leading from a stationary connection (5) around the separation unit (4) and connected to the separation unit on a side facing away from the stationary connection, and at least one bearing (7) to support the line (6), having a sliding bushing (9) and a bearing shell (13) sitting on the line. The centrifuge is characterized in that the bearing shell (13) is mounted on the rotating frame (1), with the bearing shell and the sliding bushing (9) each having a sliding surface (11, 15) with a widening radius, so that the sliding bushing is supported on the bearing shell in the axial and radial directions.

Another object of the present invention is to provide a line for supplying and/or removing at least one fluid to and/or from the separation unit of a centrifuge that will be simple and inexpensive to manufacture and will permit operation of the centrifuge at high rotation speeds with relatively minor mechanical stresses on the line.

The present invention provides a line for supplying and/or removing at least one fluid from a separation unit rotatably mounted on a rotating frame, which is in turn rotatably mounted on a base, where the separation unit is driven in the same direction of rotation as the rotating frame but at twice the speed, with at least one sliding bushing (9) sitting on the line. The line is characterized in that the sliding bushing (9) has a sliding surface (1) with a widening increasing radius, so that the sliding bushing can be inserted into a bearing shell and is supported in the axial and radial directions.

With the centrifuge according to the present invention, a sliding bushing with a widening, preferably conical, sliding surface sits on the line for supplying and/or removing at least one fluid, while a bearing shell is mounted on the rotating frame of the centrifuge with a sliding surface that also widens. The bearing shell here is preferably open to ensure easy insertion of the bushing. The bearing arrangement preferably has a catch option, with an elongated slot-shaped opening in the bearing shell being slightly narrower than the diameter of the bushing. However, conventional insertion mechanisms may also be used and are covered by the present invention.

Since the line includes only the sliding bushing, it is simple and inexpensive to manufacture. The sliding bushing may be designed as a separate part, preferably an injection molded part, which is pushed onto the line and attached to the line in a rotationally fixed manner, e.g., by welding or gluing. As an alternative, the sliding bushing may also be manufactured in one piece with the line.

In this context, a line for supplying and/or removing at least one fluid is understood to refer not only to a hose with one or more lumens but also an arrangement of multiple single-lumen hoses.

In a preferred embodiment, the sliding bushing is made of a material of less hardness than the material of which the bearing shell is made. This has the advantage that it ensures the fatigue strength of the bearing shell, which is not replaceable. Wear on the sliding bushing, however, is not a problem since this is part of the line intended for a single use.

With the bearing composed of sliding bushing and bearing shell, the centrifugal forces acting on the line are transmitted to the rotating frame, thus relieving the load on the line. Parts of the sliding surfaces of the bearing shell and the friction bearing which come in contact are so small that heat and abrasion are low and little noise is generated. The widening of the sliding surface and a peripheral projection ensure accurate centering and concentric running of the line. This permits an increase in the rotational speed of the centrifuge and prevents the bushing from slipping out of the bearing shell. There is also a speed-dependent pressing of the sliding bushing in the bearing shell with minimal friction losses.

The sliding bushing is preferably made of plastic, especially a polyacetal plastic (POM) or TEFLON brand polytetrafluoroethylene, i.e., a material with a low abrasion resistance, whereas the bearing shell is preferably made of metal, especially steel, i.e., a material with a higher abrasion resistance. Especially materials with a low coefficient of friction are advantageous. The sliding surfaces of the bearing shell and sliding bushing are preferably machined to yield minimal friction losses.

In a preferred embodiment, the sliding bushing and bearing shell each have a cylindrical section connected to the sliding surface. The cylindrical sections of the sliding bushing and bearing shell are not a running surface, but instead serve only for additional centering and adjustment of the line. The sliding surface of the sliding bushing is pressed against the sliding surface of the bearing shell by the inherent tension in the line, as a result of which the cylindrical sections of the sliding bushing and bearing shell are not stressed. The sliding surfaces are preferably designed to form only a very small circular bearing surface.

To permit insertion of the sliding bushing sitting on the line into the bearing shell, the bearing shell is advantageously slotted on one side. The cylindrical section of the sliding bushing is inserted into the side opening, and the sliding surface of the sliding bushing is then placed on the sliding surface of the bearing shell. This centers the sliding bushing in the bearing shell.

In practice, it has been found that the line can slip out of the bearing shell, especially while the centrifuge is starting up. The cylindrical section of the sliding bushing therefore preferably has a peripheral projection which effectively prevents the line from slipping out.

The friction bearing for supporting the line is preferably arranged laterally on the rotating frame of the centrifuge carrying the separation unit, so that the line can be guided in a loop around the separation unit to the stationary connection. The line is adequately supported if the friction bearing is approximately at the level at which the separation unit is arranged, i.e., in the area of the lower third of the line running from the separation unit to the stationary connection. Additional friction bearings are then no longer needed to support the line.

BRIEF DESCRIPTION OF THE DRAWINGS

An embodiment of the present invention is explained in greater detail below with reference to the drawings, in which.

DETAILED DESCRIPTION

Figure 1:
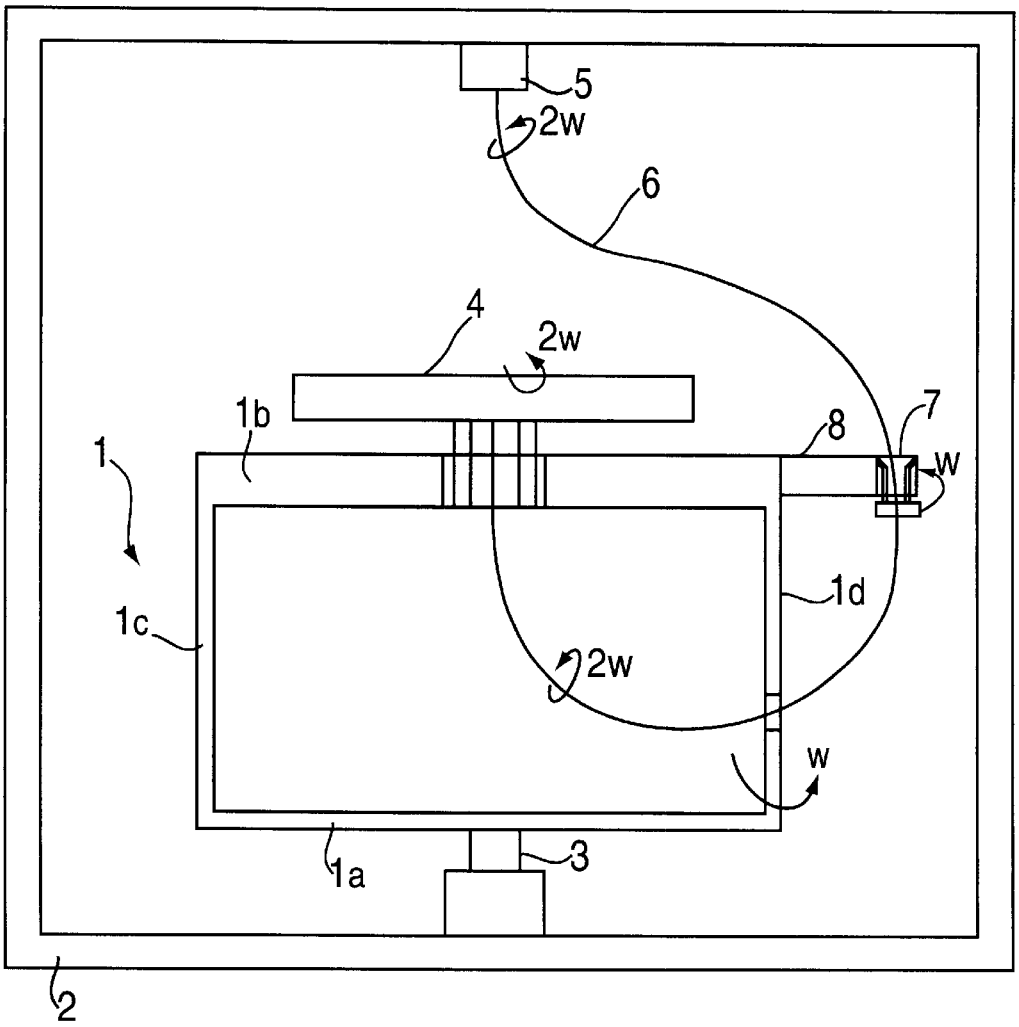
FIG. 1 shows a schematic diagram of one embodiment of a flow-through centrifuge free of rotating seals for centrifuging a biological fluid, especially blood.

FIG. 1 shows a schematic diagram of a flow-through centrifuge free of rotating seals for centrifuging a biological fluid, especially blood, where the design and function correspond to those of the centrifuge described in German Patent Application No. 32 42 541 A1, which is hereby expressly incorporated by reference herein. The flow-through centrifuge has a rotating frame 1 with a bottom carrying plate 1*a* and a top carrying plate 1*b* and two side parts 1*c*, 1*d*. Rotating frame 1 is mounted on a stationary base 2 to rotate about a vertical axis 3, and is driven at a speed $n_1$ by a drive unit, not shown in FIG. 1. A separation unit 4 in the form of a cylindrical chamber is mounted on top carrying plate 1*b* of rotating frame 1 to rotate about the axis of rotation of the frame. The separation chamber is driven by a drive unit, not shown, in the same direction of rotation as the rotating frame but at twice the speed (rpms) $n_2=2n_1$. The separation unit can be mounted on the top or bottom side of the carrying plate.

A flexible line 6 combining one or more hoses for supplying and removing the blood or blood constituents into centrifuge chamber 4 or out of the chamber leads from a stationary connection 5 on centrifuge base 1 around centrifuge chamber 4, where it is connected to the bottom side of the chamber. Twisting of the line is prevented by the fact that line 6 rotates at half the speed of the centrifuge chamber.

Line 6 is part of a disposable unit which may also include, in addition to centrifuge chamber 4, bags for collecting the blood components separated by centrifugation. The disposable unit is inserted into the centrifuge and discarded after use. Such hose arrangements are known from the related art, so that no further explanation is necessary here. A disposable unit including multiple collecting bags is described in German Patent Application Nos. 2 845 364 A and 2 845 399 A, for example, which are hereby expressly incorporated by reference herein.

To reduce the mechanical stress caused by centrifugal forces acting on the line designed as a multi-lumen hose, it is supported on rotating frame 1 by a bearing 7. The bearing 7, which is merely indicated in FIG. 1, is mounted on a side arm 8 on top carrying plate 1*b* of rotating frame 1. The bearing 7 is described in greater detail below with reference to FIGS. 2 through 5.

The bearing 7 has a sliding bushing 9 sitting on the hose line and a bearing shell 13 attached to rotating frame 1.

Figure 2:
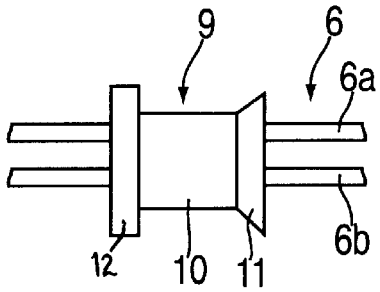
FIG. 2 shows an enlarged diagram of a line section of the hose line to be inserted into the centrifuge with a sliding bushing.
Figure 3:
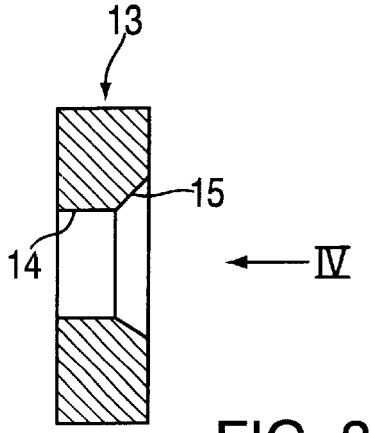
FIG. 3 shows an enlarged diagram of the bearing shell for insertion of the sliding bushing of the hose line.
Figure 4:
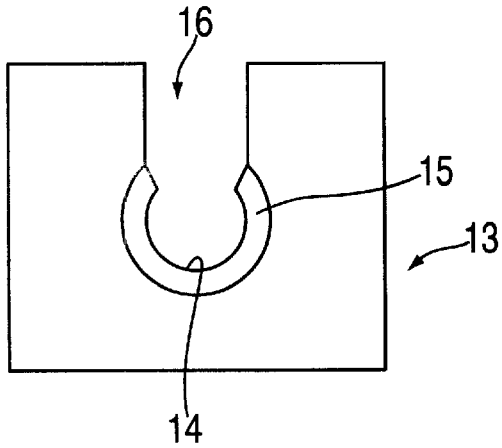
FIG. 4 shows the bearing shell from FIG. 3, as seen in the view from the direction of arrow IV.

FIG. 2 shows the section of hose line 6 comprising one or more hoses 6*a*, 6*b* with sliding bushing 9 sitting on it. Sliding bushing 9, made of a polyacetal plastic (POM) or TEFLON brand polytetrafluoroethylene, has a cylindrical section 10 which develops into a conical section 11 forming the sliding surface. Cylindrical section 10 of sliding bushing 9 is provided with a peripheral projection 12 on its end opposite the conical section. Sliding bushing 9 is fixedly glued or welded to hose line 6, extending through its axial bore.

Bearing shell 13 has an offset bore with a cylindrical section 14 and a conical section 15, having the same conicity as conical section 11 of sliding bushing 9. Bearing shell 13 has a slot 16 on one side. The width of opening slot 16 is dimensioned in such a way that cylindrical section 10 of sliding bushing 9 can be pressed laterally into bearing shell 13 and is engaged in the bearing shell with a catch. The length of cylindrical section 10 of bearing bushing 9 is slightly greater than the height of bearing shell 13.

Figure 5:
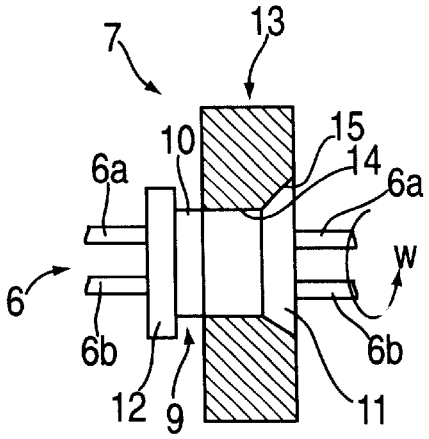
FIG. 5 shows the sliding bushing of the hose line inserted into the bearing shell.

FIG. 5 shows sliding bushing 9 of line 6 inserted into bearing shell 13. To insert sliding bushing 9, its cylindrical section 10 is inserted into side opening 16 in bearing shell 13, and conical section 11 of the sliding bushing is placed on conical sliding surface 15 of the bearing shell. The bearing shell is mounted on the rotating frame so that its sliding surface 15 is at the top. Sliding bushing 9 is secured in bearing shell 13 in axial and radial directions, with peripheral projection 12 of the sliding bushing preventing the sliding bushing from slipping out of the bearing shell.

Figure 6:
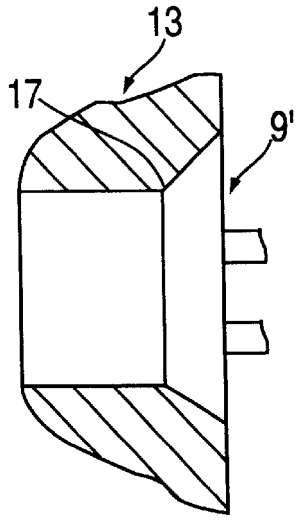
FIG. 6 shows the sliding surfaces of the bearing shell and the sliding bushing, where the bearing face is circular.

FIG. 6 shows sliding bushing 9' of another embodiment inserted into bearing shell 13. In this embodiment, the sliding surfaces of the bearing shell and the sliding bushing are designed so that the sliding bushing and bearing shell come in contact only along a circular line 17. This minimizes the bearing facing.

What is claimed is:

1. A centrifuge comprising:

a base;

a rotating frame rotatably mounted on the base;

a separation unit rotatably mounted on the base for being driven in a same direction as the rotating frame at twice a speed of rotation of the rotating frame;

a line for supplying and/or removing at least one fluid leading from a stationary connection around the separation unit and connected to the separation unit on a side facing away from the stationary connection; and at least one bearing to support the line, the at least one bearing consisting of a sliding bushing fixedly attached directly to the line and a bearing shell fixedly formed in the rotating frame, the bearing shell and the sliding bushing each having a sliding surface with a widening radius, each of said sliding surfaces being in sliding contact with the other so that the sliding bushing is supported by the bearing shell in axial and radial directions, the sliding surfaces being conical.

2. The centrifuge according to claim 1 wherein the sliding bushing has a lower hardness than the bearing shell.

3. The centrifuge according to claim 1 wherein the sliding bushing is made of plastic.

4. The centrifuge according to claim 3 wherein the sliding bushing is made of a polyacetal plastic or Teflon.

5. The centrifuge according to claim 1 wherein the bearing shell is made of metal.

6. The centrifuge according to claim 5 wherein the bearing shell is made steel.

7. The centrifuge according to claim 1 wherein the sliding bushing has a cylindrical section connected to the sliding surface of the sliding bushing, and the bearing shell has a cylindrical section connected to the sliding surface of the bearing shell.

8. The centrifuge according to claim 7 wherein the cylindrical section of the sliding bushing is provided with a peripheral projection.

9. The centrifuge according to claim 1 wherein the bearing shell is slotted on one side for inserting the sliding bushing.

10. A line for supplying and/or removing at least one fluid from a separation unit rotatably mounted on a rotating frame, the frame being rotatably mounted on a base and the separation unit being driven in a same direction of rotation as the rotating frame at twice a speed of rotation of the rotating frame, the line comprising:

at least one bearing supporting the line, said at least one bearing consisting of a sliding bushing fixedly attached directly to the line having a sliding surface with a widening increasing radius, so that the sliding bushing can be inserted into a bearing shell fixedly formed in the rotating frame, said sliding bushing being supported in the axial and radial directions by the bearing shell, the sliding surface being conical.

11. The line according to claim 10 wherein the at least one sliding bushing is made of plastic.

12. The line according to claim 11 wherein the at least one sliding bushing is made of one of a polyacetal plastic and polytetrafluoroethylene.

13. The line according to claim 10 wherein the sliding bushing has a cylindrical section connected to the sliding surface.

14. The line according to claim 13 wherein the cylindrical section of the sliding bushing is provided with a peripheral projection.

15. A method of centrifuging comprising:

supplying a biological fluid through a line from a stationary connection to a separation unit rotatably mounted on a base, the fluid being supplied to a side of the separation unit facing away from the stationary connection;

rotating the separation unit;

rotating a frame mounted on the base in a same direction as the separation unit at half a rotational speed of the separation unit; and supporting the line in at least one bearing consisting of a sliding bushing having a conical sliding surface with a widening increasing radius fixedly attached directly to the line and a bearing shell fixedly formed in the frame, the bearing shell and the sliding bushing sliding one against the other so that the sliding bushing is supported by the bearing shell in axial and radial directions.

16. The method according to claim 15 further comprising supporting the sliding bushing using a peripheral projection.

* * * * *